United States Patent [19]

Yoshio et al.

[11] Patent Number: 4,642,812

[45] Date of Patent: Feb. 10, 1987

[54] SOUND FIELD ENLARGING DEVICE AND METHOD

[75] Inventors: Junichi Yoshio; Toshio Hirano; Kenichiro Yasukawa; Masayuki Yoshida, all of Saitama, Japan

[73] Assignee: Pioneer Electronic Corp., Tokyo, Japan

[21] Appl. No.: 726,267

[22] Filed: Apr. 23, 1985

[30] Foreign Application Priority Data

Apr. 23, 1984 [JP] Japan ..... 59-58456[U]

[51] Int. Cl.[4] ..... H04R 5/00

[52] U.S. Cl. ..... 381/1; 369/87

[58] Field of Search ..... 369/86, 88, 89; 381/1, 381/17, 18, 19

[56] References Cited

U.S. PATENT DOCUMENTS 4,118,599 10/1978 Iwahara et al. ..... 381/19

*Primary Examiner*—Forester W. Isen

*Attorney, Agent, or Firm*—Sughrue, Mion, Zinn Macpeak & Seas

[57] ABSTRACT

A method for performing sound field enlargement in a digital audio reproducing apparatus such as a compact disc player. A sum is calculated between each received pair of right-channel and left-channel data read from the disc, and the resulting sum data is stored in a random access memory. After a predetermined delay time, the sum data are read from the memory and multiplexed with the then-incoming right-channel and left-channel data. The resulting data stream is converted to respective right-channel, left-channel, and delayed-sum analog signals, which are then subjected to low-pass filtering. The filtered signals are processed in a conventional manner to yield outputs signals which, when reproduced, produce a perception of an enlarged sound field.

10 Claims, 2 Drawing Figures

SOUND FIELD ENLARGING DEVICE AND METHOD

BACKGROUND OF THE INVENTION

The present invention relates to a digital audio reproducing device and method such as may be used with a digital audio disc player. More particularly, the invention relates to a digital audio reproducing device and method for producing audio signals which, when reproduced, yield a perception of an enlarged sound field.

In a conventional sound field enlarging device, as shown in FIG. 1, a right-channel audio signal $R_{in}$ and a left-channel audio signal $L_{in}$ are summed by an adder 25, and the resulting sum signal is delayed by a BBD (Bucket Brigade Device) 28. A sum and a difference of the delayed and undelayed sum signals are produced by adders 22 and 21, respectively. The former two signals are selectively attenuated by attenuators 20 and 19, respectively, and the two resulting attenuated signals are summed and differenced by adders 23 and 24. The outputs of the adders 23 and 24 are summed by adders 27 and 26, respectively, with the signals $R_{in}$ and $L_{in}$ to yield output signals $R_{out}$ and $L_{out}$. Reproduction of the signals $R_{out}$ and $L_{out}$ yields audio waves for which the perceived sound field is enlarged.

However, the above-mentioned conventional sound field enlarging device does not always offer a satisfactory dynamic range, S/N ratio, and frequency response characteristics for audio reproduction due to the use of the BBD.

Further, it may be considered to use a digital device such as an A/D converter, RAM, or D/A converter in the delay device. However, such a digital system is disadvantageous in that it requires a complex and costly circuit arrangement.

SUMMARY OF THE INVENTION

The present invention has been made in view of the above-mentioned difficulties. Specifically, an object of the present invention is to provide a digital audio reproducing device and method for sound field enlargement which does not depend on the use a BBD as a delay element and which eliminates the above-mentioned disadvantages which have been experienced with conventional devices and methods.

In accordance with the above and other objects of the invention, there is provided a digital audio reproducing device and method for processing and reproducing digitized audio signals in which a data controller computes from digital right-channel and left-channel data pairs corresponding sum data. The sum data are stored by the data controller in a random-access memory. The sum data are read from the random-access memory after a predetermined delay and multiplexed with the then-incoming right-channel and left-signal data. The data stream thus produced is converted to analog form. The resulting analog signal is demultiplexed into corresponding analog right, left, and delayed-sum signals. The three analog signals are passed through respective low-pass filters, and then processed in a conventional manner to provide output right-channel and left-channel signals which, when reproduced, yield audio waves for which the perceived sound field is enlarged.

BRIEF DESCRIPTION OF THE DRAWINGS

Other objects, features and advantages of the invention will be readily apparent from the following description of a preferred embodiment of the present invention, taken in conjunction with the accompanying drawings, in which.

DESCRIPTION OF THE PREFERRED EMBODIMENTS

Figure 1:
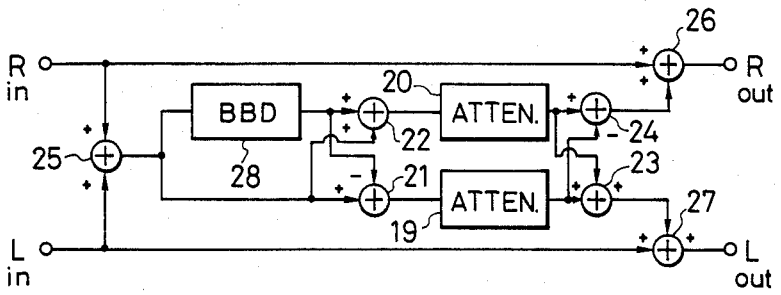
FIG. 1 PRIOR ART
FIG. 1 is a block diagram of a conventional sound field enlarging circuit.

The present invention will now be explained in detail with reference to a preferred embodiment shown in FIG. 2. In FIG. 2, reference numerals used commonly in FIG. 1 denote like components.

In this embodiment, there are provided a multiplexer 11 for multiplexing right and left channel outputs obtained serially from a signal processing section in a compact disc reproducing apparatus with a sum output, the latter being obtained by delaying by a predetermined time period a sum output (hereinbelow referred to as an "S output") which is the sum of the right and left channel outputs; a D/A converter 12 for converting the outputs of the demultiplexer 11 into analog signals; a demultiplexer 13 for dividing the output of the D/A converter 12 into right, left, and sum signals; a RAM 15 for storing therein the S output; a data controller 14 for producing the S output and storing it in the RAM and for reading out the thus-stored signal from the RAM 15 after a predetermined delay time to deliver the same to the multiplexer 11; low-pass filters 16 through 18; attenuators 19 through 20; and adders 21 through 27.

Next, the operation of this apparatus will be explained. The signal processing section of the compact disc reproducing apparatus delivers serially through its left and right output terminals digital data of . . . $R_{t-1}$, $L_{t-1}$, $R_t$, $L_t$, $R_{t+1}$, $L_{t+1}$, . . . , with 16 bits per datum, representing, alternatingly, the right and left channel signals. The serial data are delivered to the data controller 14 which creates a sum output $S_t$, for instance, with respect to the data $R_t$, $L_t$ and stores the sum output $S_t$ in the RAM 15. The data controller 14 then reads out from the RAM 15 the sum output $S_{t-n}$ that was stored a predetermined time previously in the RAM 15 and delivers the same to the multiplexer 11.

The multiplexer 11, receiving the sum output as its input, multiplexes the serial data . . . $R_{t-1}$, $L_{t-1}$, $S_{t-1-n}$, $R_t$, $L_t$, $S_{t-n}$, $R_{t+1}$, $L_{t+1}$, $S_{t+1-n}$, . . . . Although not indicated in FIG. 1, the multiplexer 11 processes the L and R data in pairs, and further receives in parallel the S data. The data output from the multiplexer 11 is in serial form in which the time width of each bit is compressed to substantially two-thirds that of the original data.

The data from the multiplexer 11 are delivered to the D/A converter 12 for transformation into analog signals, which are applied to the demultiplexer 13. The demultiplexer 13, which is mainly composed of analog switches, sample-and-hold circuits, etc., issues in analog form the right channel signal, the left channel signal, and the sum signal, which are then respectively delivered to low-pass filters 16, 17 and 18 which remove high-frequency components therefrom.

Figure 2:
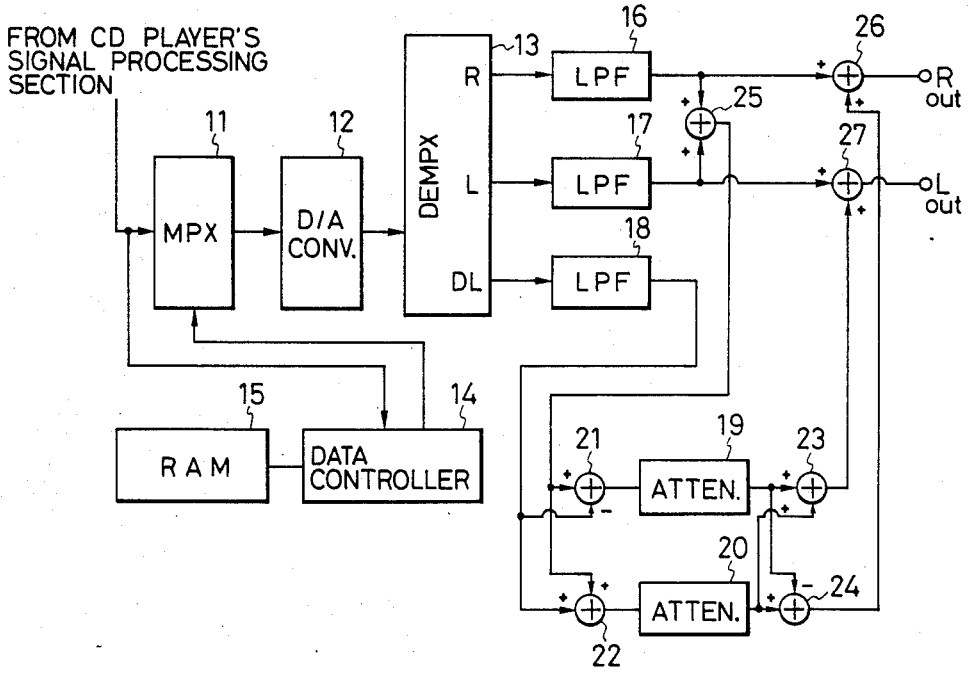
FIG. 2 is a block diagram of a preferred embodiment of a digital audio reproducing device of the present invention.

The inventive circuit shown in FIG. 2, performs the same general function as the conventional sound field enlarging device shown in FIG. 1. That is, the inputs $R_{in}$ and $L_{in}$ in FIG. 1 correspond to the outputs of the low-pass filters 16 and 17, respectively, in the preferred embodiment of FIG. 2. The output of the low-pass filter 18 in the preferred embodiment is equivalent to the output of the BBD 28 in the conventional device. It is of course noted though that instead of the BBD 28 used in the conventional device, a combination of the multiplexer 11, data controller 14, RAM 15, and demultiplexer 13 generates the delayed sum signal. The conventional theory in the field of sound spreading is applicable as well to the invention.

More specifically, as is well-known, an estimate of a correlation coefficient $\delta_{LR}$ between outputs $R_{OUT}$ and $L_{OUT}$ is given by:

$$\delta_{LR} = \frac{\overline{L_{OUT}(t)\, R_{OUT}(t)}}{\sqrt{\overline{L_{OUT}^2(t)}\ \overline{R_{OUT}^2(t)}}} \quad (1)$$

When $\delta_{LR}$ has a large negative value, the sensed acoustic spreading is generally increased. In expression (1), $\delta_{LR}$ is a function of time, and the overhead lines indicate time-averaged values.

In this embodiment, estimating that the ratio of the attenuation coefficients of the attenuators 19 and 20 is 1:H, $$\delta_{LR} = \frac{1 - H^2}{1 + H^2}.$$

Thus, by suitably selecting the attenuation coefficients of the attenuators 19 and 20, the value of $\delta_{LR}$ can be made negative, and therefore the sensation of sound spreading can be created.

It is noted that timing and control of the overall circuit arrangement of FIG. 1 is effected with the use of, for example, clock pulses from the signal processing section of the compact disc reproducing apparatus, although this is not specifically shown in FIG. 1.

The present invention has been explained herein with reference to a preferred embodiment applied to a compact disc reproducing apparatus. However, the present invention can also be applied in the same manner as mentioned above to any other digital audio reproducing apparatus.

As mentioned hereinabove, according to the present invention, perceived enlargement of the sound field can be realized by utilizing a digital delay device other than a BBD. Further, since the digital audio reproducing apparatus itself processes digital audio data, the digital delay function can be effected simply, thereby providing a sound field enlarging device at a low cost. Moreover, the dynamic range, S/N ratio, and frequency response characteristics are enhanced greatly in comparison with conventional devices.

We claim:

1. A sound field enlarging device for a reproducing apparatus supplying right-channel and left-channel signals as a sequence of pairs of digital data, comprising:

means for calculating a sum datum for each of said pairs of digital data; 'means for delaying the sum data for a predetermined delay period relative to the corresponding pairs of digital data;

means for converting said digital data pairs and the delayed sum data to corresponding analog signals; and means for combining said analog signals to produce output right-channel and left-channel signals with a negative correlation between said output right-channel and left-channel signals.

2. The sound enlarging device of claim 1, wherein said calculating means comprises data controller means.

3. The sound enlarging device of claim 2, wherein said delaying means comprises a random-access memory coupled to said data controller means.

4. The sound enlarging device of claim 3, wherein said converting means comprises a digital-to-analog converter and an analog demultiplexer receiving an output of said digital-to-analog converter.

5. The sound enlarging device of claim 1, wherein said combining means comprises: a first adder for adding an analog right-channel signal and an analog left-channel signal output from said converting means; a second adder for adding an output of said first adder to an analog delayed-sum signal output from said converting means; a third adder for subtracting said analog delayed-sum signal from said output of said first adder; a first attenuator receiving as an input an output of said third adder; a second attenuator receiving as an input an output of said second adder; a fourth adder for subtracting an output of said first attenuator from an output of said second attenuator; a fifth adder for adding said output of said first attenuator to said output of said second attenuator; a sixth adder for adding an output of said fourth adder to said analog right-channel; and a seventh adder for adding an output of said fifth adder to said analog left-channel signal to produce an output left-channel signal.

6. The sound enlarging device of claim 5, further comprising first through third low-pass filters connected in series with respective outputs of said converting means for effecting low-pass filtering of said analog right-channel, left-channel, and delayed-sum signals.

7. A method for producing audio output signals which, when reproduced, yield sound waves for which the sound field is perceived to be enlarged, comprising the steps of: receiving in sequence pairs of right-channel and left-channel data; computing a sum between a right-channel datum and a left-channel datum for each of said pairs; storing the sums in a memory; reading said sums from said memory a predetermined delay period after the corresponding right-channel and left-channel data were received; multiplexing the read-out sums with presently received pairs of right-channel and left-channel data; converting the multiplexed data to respective right-channel, left-channel, and delayed-sum analog signals; subjecting each of said analog signals to low-pass filtering; summing the filtered right-channel and left-channel analog signals to produce a first analog sum signal; summing said first analog sum signal and the filtered delayed-sum analog signal to produce a second analog sum signal; forming a difference between said first analog sum signal and said filtered delayed-sum signal to produce a third analog sum signal; attenuating said second and third analog sum signals to produce respective fourth and fifth analog sum signals; summing and differencing said fourth and fifth analog sum signals and summing the resulting signals with said filtered right-channel and left-channel analog signals to produce respective output signals.

8. The method of claim 7, wherein said step of attenuating comprises attenuating said second and third analog sum signals with attenuation coefficients determined such that a correlation coefficient between said output signals is negative.

9. The method of claim 7, wherein said step of converting comprises performing a digital-to-analog conversion of said data, and performing analog demultiplexing of the resulting analog signal.

10. The method of claim 7, wherein said steps of computing said sum and storing said sums is performed by a data controller device.

* * * * *